United States Patent [19]

Moorehead et al.

[11] Patent Number: 4,744,884

[45] Date of Patent: May 17, 1988

[54] PROCESS FOR PRODUCING LUBRICATION OIL OF HIGH VISCOSITY INDEX

[75] Inventors: Eric L. Moorehead, Diamond Bar, Calif.; Sidney Y. Shen, Cypress, Tex.

[73] Assignee: Union Oil Company of California, Los Angeles, Calif.

[21] Appl. No.: 867,768

[22] Filed: May 28, 1986

Related U.S. Application Data

[63] Continuation-in-part of Ser. No. 779,939, Sep. 25, 1985, abandoned.

[51] Int. Cl.[4] ..... C10G 45/00; C10G 47/02

[52] U.S. Cl. ..... 208/111; 208/89

[58] Field of Search ..... 208/61, 57, 58, 59, 208/89, 97, 109, 111

[56] References Cited

U.S. PATENT DOCUMENTS

| | | | |
|---|---|---|---|
| 3,523,071 | 8/1970 | Knapp et al. | 208/106 |
| 3,637,484 | 1/1972 | Hansford | 208/143 |
| 3,642,610 | 2/1972 | Divijak, Jr. et al. | 208/58 |
| 3,755,138 | 8/1973 | Chen et al. | 208/111 X |
| 3,929,617 | 12/1975 | Henry et al. | 208/96 |
| 3,941,680 | 3/1976 | Bryson et al. | 208/80 |
| 4,028,224 | 6/1977 | MacDonald et al. | 208/92 |
| 4,046,674 | 9/1977 | Young | 208/251 H |
| 4,153,540 | 5/1979 | Gorring et al. | 208/89 |
| 4,213,847 | 7/1980 | Chen et al. | 208/111 |
| 4,238,318 | 12/1980 | Kouwenhoven et al. | 208/120 |
| 4,283,271 | 8/1981 | Garwood et al. | 208/59 |
| 4,292,166 | 9/1981 | Gorring et al. | 208/59 |
| 4,294,687 | 10/1981 | Pinaire et al. | 208/89 |
| 4,347,121 | 8/1982 | Mayer et al. | 208/58 |
| 4,357,232 | 11/1982 | Holland et al. | 208/87 |
| 4,361,477 | 11/1982 | Miller | 208/67 |
| 4,395,327 | 7/1983 | Pelrine | 208/216 R |
| 4,412,087 | 10/1983 | Trepka | 585/12 |
| 4,428,825 | 1/1984 | Ward et al. | 208/109 |
| 4,428,862 | 1/1984 | Ward et al. | 208/111 X |
| 4,431,517 | 2/1984 | Nevitt et al. | 208/111 |
| 4,437,975 | 3/1984 | Gillespie et al. | 208/87 |
| 4,490,242 | 12/1984 | Oleck et al. | 208/97 |

*Primary Examiner*—Helen M. S. Sneed
*Assistant Examiner*—Glenn Caldarola
*Attorney, Agent, or Firm*—Dean Sandford; Gregory F. Wirzbicki

[57] ABSTRACT

Full-range shale oils or fractions thereof, after hydrotreating, or hydrowaxed and then hydrogenated to produce lubricating oil fractions boiling above 650° F., having a pour point at or below +10° F., and a viscosity index of at least 95. In the preferred operation, the hydrogenation is effected with a noble metal-containing catalyst wherein the noble metal is dispersed by cation exchange into a carrier comprising a silica-alumina cogel or copolymer dispersed in a large pore alumina gel matrix. It has been found with shale oils that the hydrogenation in the preferred embodiment also results in hydrocracking of some of the polynaphthenic compounds. Since polynaphthenic compounds can contribute to or themselves cause low viscosity index in lubricating base oil, the invention is believed particularly applicable to those feedstocks, not necessarily of shale origin, wherein it is desired or necesary to raise the viscosity index by hydrogenation with simultaneous hydrocracking of polynaphtenic compounds .

105 Claims, 1 Drawing Sheet

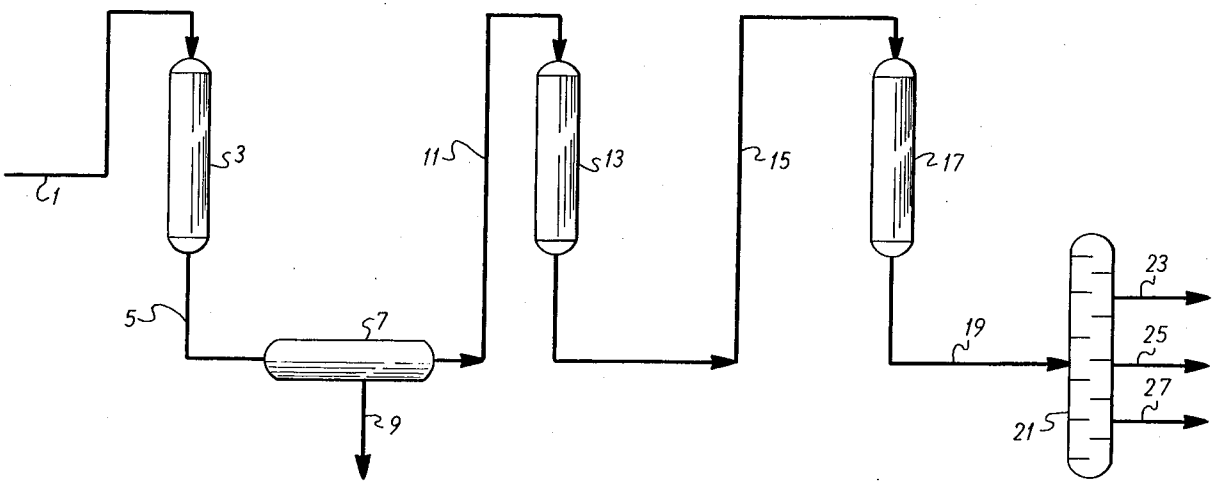
1
3
5
7
9
11
13
15
17
19
21
23
25
27

PROCESS FOR PRODUCING LUBRICATION OIL OF HIGH VISCOSITY INDEX

CROSS-REFERENCE TO RELATED PATENT APPLICATIONS

This patent application is a continuation-in-part of U.S. patent application Ser. No. 779,939 filed Sept. 25, 1985, abandoned.

BACKGROUND OF THE INVENTION

This invention relates to the production of premium lubricating base oils from shale oils.

Methods of recovering a raw shale oil from oil shale are well known, and as with petroleum crudes, a raw shale oil (sometimes called a syncrude) must be upgraded to products which are of commercial utility. For example, in U.S. Pat. No. 4,428,862, a method is taught for successively deashing, dearseniting, hydrotreating and hydrodewaxing a raw shale oil so as to produce a "pipelineable" shale oil having a relatively low pour point (i.e., +30° F. or less). Such pipelineable shale oils are disclosed to contain various jet fuel and diesel fuel fractions meeting appropriate commercial freeze point and pour point requirements.

Another product of commercial interest is lubricating base oil. Lubricating base oils are generally categorized by their boiling point range, as shown in the following table:

TABLE I

| Lubricating Base Oil Designation | Typical Boiling Point Range, °F. |
|---|---|
| Light Neutral | 650 to 825 |
| Medium Neutral | 700 to 925 |
| Heavy Neutral | 800 to 1025 |
| Bright Stock | 1000+ |

Commercially acceptable lubricating oils generally are composed of blends of base oils having a pour point no greater than +10° F. while also having viscosity indices typically between 90 and 100. Viscosity index is a measure of how well a lubricating oil maintains its viscosity as a function of temperature, with ever increasing viscosity index values being indicative of oils which better maintain their viscosity with change in temperature. For most lubricating oils, a desired viscosity index is 95 or higher.

Yet another product of commercial interest is transformer oil, which typically boils in the range of 610° to 650° F. For transformer oils, there is no viscosity index requirement, since temperature fluctuations in transformer service are minimal. However, there are stringent pour point requirements. Transformer oils are required to have a pour point no greater than −40° F.

SUMMARY OF THE INVENTION

The present invention provides a process for treating a hydrotreated, full-range shale oil so as to obtain a product shale oil containing lubricating base oils of desirable pour point and viscosity index characteristics. Specifically, the process involves first hydrodewaxing the hydrotreated, full-range shale oil in the presence of a hydrodewaxing catalyst, which typically contains one or more hydrogenation components on a support containing a dewaxing component, such as ZSM-5, silicalite, mordenite, and the like, and then hydrogenating the resultant product in the presence of a hydrogenation catalyst, which typically contains a hydrogenation metal component on a support. Preferred operation involves using as the hydrodewaxing catalyst a composite containing nickel and tungsten components on a support containing above about 70 percent by weight silicalite and the remainder an amorphous refractory oxide such as alumina and using as the hydrogenation calalyst the catalyst disclosed in U.S. Pat. No. 3,637,484, i.e., platinum and/or palladium deposited selectively by cation exchange upon a silica-alumina cogel or copolymer dispersed in a large pore alumina gel matrix. Preferred operation also involves operating the hydrogenation stage of the process at a temperature above 700° F., with temperatures between 725° and 750° F. being highly preferred.

The shale oil product produced by the process of the invention, when fractionated, yields lubricating base oils suitable for commercial use, having a pour point at or below +10° F. and a viscosity index of at least 95.

One unusual feature of the invention is that the preferred hydrogenation catalyst, disclosed in U.S. Pat. No. 3,637,484, has been found to upgrade hydrotreated and hydrodewaxed shale oil at least in part by hydrocracking polynaphthenic compounds, this hydrocracking apparently being in preference to the hydrocracking of paraffins and mono-naphthenic compounds. That is to say, the catalyst is active for hydrocracking a greater percentage of polynaphthenic compounds than paraffins or mono-naphthenic compounds. In any event, it is certain that the preferred hydrogenation catalyst does hydrocrack polynaphthenic compounds in significant proportions, and since polynaphthenic compounds contribute to, or are responsible for, the low viscosity index of lubricating oils, it is also certain that the improvement in viscosity index caused by the use of said catalyst on hydrotreated and hydrodewaxed shale oils is due to its activity for hydrocracking polynaphthenic compounds. Accordingly, it is one embodiment of the invention to upgrade hydrocarbon stocks containing polynaphthenic compounds by hydrocracking said polynaphthenic compounds in the presence of the catalyst of U.S. Pat. No. 3,637,484 and increasing the viscosity index thereof, preferably to a value of 95 or greater.

BRIEF DESCRIPTION OF THE DRAWING

The drawing depicts in flow sheet format a preferred process carried out in accordance with the invention.

DETAILED DESCRIPTION OF THE INVENTION

This invention is directed to producing quality (or premium) lubricating base oils from raw shale oil, and particularly from shale oil derived from oil shale from the Colorado River formation and adjacent areas in the western United States. Shale oil may be recovered from such shales by pyrolysis in a retort and may then be upgraded by any of several methods. In one upgrading method, as disclosed in U.S. Pat. No. 4,428,862 herein incorporated by reference in its entirety, a full-range (i.e., non-fractionated) raw shale oil is successively (1) deashed by filtration or electrostatic agglomeration, (2) dearsenified by contact with a catalyst containing nickel and molybdenum components on an amorphous, porous refractory oxide support in a manner similar to that disclosed in U.S. Pat. No. 4,046,674, herein incorporated by reference in its entirety, (3) hydrotreated at elevated temperature and pressure in the presence of a catalyst comprising Group VIB and VIII metal components on a refractory oxide support, and (4) finally, hydrodewaxed in the presence of a catalyst comprising a Group VIB metal component on a support containing silicalite.

When upgrading full-range shale oil derived from Colorado oil shale or the like in accordance with the method disclosed in U.S. Pat. No. 4,428,862, it has been found that the product yielded from the hydrotreating stage, when fractionated, contains lubrication oil fractions having commercially unacceptable pour points, i.e., on the order of +35° F. or more. But it has also been found, when the hydrodewaxing catalyst is modified to contain more than 70 percent silicalite in the support, and when the full range shale oil is hydrodewaxed to an overall pour point less than −40° F., that the product yielded from the hydrodewaxing stage contains lube oil fractions of acceptable pour point, i.e., +10° F. or less, but of drastically reduced viscosity index—substantially below 95. These facts are demonstrated in the following Example I:

EXAMPLE I

A full-range raw shale oil derived from a Colorado oil shale, designated F-3903 and having a boiling range of about 200° to 1100° F., was deashed by electrostatic precipitation and then dearsenified in the presence of a sulfided nickel-molybdenum catalyst containing an essentially non-cracking support. The dearsenification was accomplished by the method described in U.S. Pat. Nos. 4,046,674 and 4,428,862. The catalyst was composed of about 42 percent by weight of nickel components, calculated as NiO, and about 8 percent by weight of molybdenum components, calculated as $MoO_3$, on an alumina support. The catalyst was in the form of particulates having a cross-sectional shape of a three-leaf clover, as disclosed in FIGS. 8 and 8A in U.S. Pat. No. 4,028,227, said catalyst having a maximum cross-sectional length "D" shown in said FIG. 8A of about 1/22 inch.

The dearsenified product was then hydrotreated in the presence of a sulfided catalyst comprising about 4 percent by weight nickel components (calculated as NiO), about 24 percent by weight of molybdenum components (calculated as $MoO_3$), and about 4 percent by weight of phosphorus (calculated as P) on an alumina support. The hydrotreating catalyst, having a mean pore diameter between about 75 and 80 angstroms, about 75 percent of its pore volume in pores of diameter between 60 and 100 angstroms, and a surface area of about 160 $m^2$/gm, was about 1/20 inch in its longest cross-sectional length. The catalyst was of quadrilobal shape wherein two relatively large lobes of about equal size shared the same axis, which axis was at a right angle to a second axis containing two relatively small lobes of about equal size. The hydrotreating was accomplished under conditions of elevated temperature and pressure, and in the presence of hydrogen, so as to yield a product containing less than 700 wppm nitrogen, and specifically, to yield a product containing 500 wppm nitrogen. The following Table II summarizes the properties of various fractions of the hydrotreated product boiling in the lubricating and transformer oil ranges:

TABLE II

| Fraction °F. | Gravity °API | Vol. % of Product | Pour Point, °F. | VI |
|---|---|---|---|---|
| 610–650 | 33.7 | 9.19 | 43 | 84.2 |
| 650–690 | 31.9 | 7.22 | 59 | 83.4 |
| 690–790 | 29.6 | 13.84 | 81 | 101.3 |
| 790–830 | 28.4 | 5.30 | 97 | 107.2 |
| 830–875 | 27.6 | 8.46 | 108 | 107.2 |
| 875+ | 26.3 | 13.66 | >113 | 102.3 |
| | Total | 57.67 | | |

As shown by the foregoing data, all of the fractions boiling above 610° F. had a pour point far greater than the +10° F. maximum desired for lubricating base oils.

The hydrotreated shale oil containing the transformer and lubrication oil fractions identified in Table II and having an API gravity of 33.6 and a pour point of about 80° F. was then hydrodewaxed in the presence of a sulfided, particulate catalyst comprising 2.17 weight percent nickel components, calculated as NiO, and 14.5 weight percent of tungsten components, calculated as $WO_3$, on a support consisting essentially of 80 percent by weight silicalite and 20 percent by weight of alumina and Catapal TM alumina binder. The catalyst had a cylindrical shape and a cross-sectional diameter of 1/16 inch. The operating conditions used in the experiment were as follows: 750° F. operating temperature, 2,000 p.s.i.g. total pressure, 16,000 $ft^3$/bbl of hydrogen (once through), and a space velocity of 1.0 v/v/hr. The properties of the lubricating and transformer fractions in the resultant product, which product had an overall pour point of −65° F., are summarized in the following Table III:

TABLE III

| Fraction °F. | Gravity °API | Vol. % of Product | Pour Point, °F. | VI |
|---|---|---|---|---|
| 610–650 | 28.6 | 7.36 | −65 | 40.8 |
| 650–690 | 27.7 | 5.97 | −60 | 32 |
| 690–790 | 26.2 | 11.63 | −54 | 37.3 |
| 790–830 | 26 | 6.48 | −27 | 57.9 |
| 830–875 | 25.2 | 6.50 | 10 | 65.2 |
| 875+ | 26.1 | 10.70 | 10 | 83.9 |
| | Total | 48.64 | | |

As shown in Table III, the pour points of all the various fractions were acceptable, being at or below 10° F. in the case of lube oils and below −40° F. in the case of the transformer oil boiling in the 610° to 650° F. range. However, the viscosity indices of the lube oil fractions, i.e., those boiling above about 650° F., were clearly incompatible with the desired goal, being far below the 95 value required for commercially acceptable lubricating base oils.

The foregoing example confirms that the deashing-dearseniting-hydrotreating-hydrodewaxing process described in U.S. Pat. No. 4,428,862, although yielding a shale oil having an overall pour point suited for transport in a pipeline, does not yield even one lubricating oil fraction having the desired viscosity index of 95 or more. In the present invention, this problem is overcome by hydrogenating the shale oil product, after hydrodewaxing, in the presence of a hydrogenation catalyst, such as that described in U.S. Pat. No. 3,637,484, herein incorporated by reference in its entirety. In so doing, it has been found that all the lubricating oil fractions will meet appropriate pour point and viscosity index requirements. This result is considered surprising, not only because the viscosity index of the various lube oil fractions in the hydrodewaxed shale oil is so low to begin with but also because hydrogenation generally tends to increase the pour point. See for example column 13, lines 4 to 17 of U.S. Pat. No. 4,428,862. However, as is shown by the data in the following Example II, hydrogenation of the hydrodewaxed shale oil yields lubricating oils having a pour point at or below +10° F. and a viscosity index of 95 or more.

EXAMPLE II

The product of the hydrodewaxing treatment described in Example I, having a gravity of 35.9 API and a pour point overall of −65° F., was then hydrogenated in the presence of a noble metal-containing catalyst at a temperature of 750° F. and at a space velocity of 0.5 v/v/hr and at a pressure of 2,000 p.s.i.g. and a hydrogen feed rate (once through) of about 8,000 $ft^3$/bbl. The catalyst comprises about 0.55 to 0.60 weight percent platinum on a support containing, overall, about 75 weight percent alumina and about 25 weight percent silica. The catalyst is prepared by a method similar to that described in U.S. Pat. No. 3,637,484 wherein the platinum is introduced by cation exchange on a carrier prepared by mulling about 33 parts by dry weight of a 75/25 silica-alumina "graft copolymer" with 67 parts by dry weight of hydrous alumina gel, followed by spray-drying, rehomogenization with added water, extrusion, and calcination. The catalyst is in the form of cylindrical particulates of about 1/12-inch diameter and length of between about 1/16 and ½ inch. The shale oil product, having an API gravity of 44, yielded from the hydrogenation treatment was found to have lubricating oil and transformer oil fractions having the characteristics summarized in the following Table IV:

TABLE IV

| Fraction °F. | Gravity °API | Vol. % of Product | Pour Point, °F. | VI |
|---|---|---|---|---|
| 610–650 | 35 | 6.58 | −54 | 76.8 |
| 650–690 | 34.7 | 7.28 | −27 | 80.8 |
| 690–790 | 34.7 | 10.30 | −11 | 95.2 |
| 790–830 | 35.1 | 3.24 | 0 | 109.7 |
| 830–875 | 34.1 | 3.52 | 10 | 120.4 |
| 875+ | 33.5 | 4.95 | 10 | 129.5 |
| | Total | 35.87 | | |

As shown, the transformer oil fraction boiling between 610° and 650° F. has a pour point substantially below −40° F., and all of the lubricating oil fractions had a pour point at or below +10° F. and a viscosity index of at least 95, with the sole exception of the 650° to 690° F. lube fraction. It should be noted that the low viscosity index value for the 650° to 690° F. lube fraction is of no real concern, since it can easily be blended with the next two higher fractions and still yield a light neutral oil of appropriate characteristics. In this respect, it should be recognized that the data in Tables II through IV indicate the characteristics of extremely narrow lubricating oil cuts, and that, in commercial practice, much wider cuts are usually employed. The reason that narrow cuts were analyzed in the two Examples herein was to clearly illustrate how each of the hydrotreating, hydrodewaxing, and hydrogenation steps affected the various components of lubricating oils.

The invention can be more thoroughly understood by reference to the drawing and the following discussion. In conduit 1 is carried a full-range shale oil, and preferably a full-range shale oil which has been deashed and dearsenated, with the preferred method for dearsenating being disclosed in U.S. Pat. Nos. 4,428,862 and 4,046,674. The dearsenation treatment may, in addition to removing essentially all the arsenic contained in the raw shale oil, also reduce the nitrogen and sulfur contents of the shale oil, which are usually above about 1.5 and 0.4 weight percent, respectively, when derived from Colorado oil shale; however, while the sulfur reductions are substantial, usually on the order of about 30 to 70 percent, the nitrogen reductions are usually relatively small, e.g., on the order of 10 to 15 percent. Thus, since greater nitrogen reductions are almost always desired, the feed in conduit 1 is introduced into a hydrotreater 3 and therein contacted with a hydrotreating catalyst in the presence of hydrogen under conditions suited to effecting substantial nitrogen reductions, typically and preferably to a value below 700 wppm. The hydrotreating conditions will generally fall into the ranges shown in the following Table V:

TABLE V

HYDROTREATING OPERATING CONDITIONS

| Condition | Usual | Preferred |
|---|---|---|
| Temperature, °F. | 600–800 | 650–750 |
| Space Velocity, v/v/hr | 0.1–5.0 | 0.3–2.0 |
| Pressure, p.s.i.g. | 500–2,500 | 1,000 - 2,500 |
| $H_2$ Recycle Rate, scf/bbl | 4,000–20,000 | 6,000–12,000 |
| $H_2$ Mole Percent in Recycle Gases | >85 | >90 |

Any conventional hydrotreating catalyst may be employed in hydrotreater 3, and these generally comprise a Group VIB metal component and a Group VIII metal component on an amorphous, porous refractory oxide support, with the most typical and preferred support being an essentially non-cracking material such as alumina. Preferably, the hydrotreating catalyst contains nickel and/or cobalt components as the Group VIII metal component and molybdenum and/or tungsten components as the Group VIB metal component. Optionally, the catalyst may also contain other components, such as phosphorus, and usually the catalyst is activated by sulfiding prior to use or in situ. Usually, the hydrotreating cstalyst contains the Group VIII metal component in a proportion between about 0.5 and 15 percent by weight, preferably between 1 and 5 percent by weight, calculated as the metal monoxide, and the Group VIB metal component in a proportion between about 5 and 40 percent by weight, and preferably between about 15 and 30 percent by weight, calculated as the metal trioxide, on an alumina or other porous refractory oxide support providing a surface area in the final catalyst of at least 100 $m^2$/gm, preferably more than 125 $m^2$/gm. The most preferred catalyst for present use as a hydrotreating catalyst contains about 4 weight percent of nickel components (calculated as NiO) and about 24 weight percent of molybdenum components (calculated as $MoO_3$) and about 3 to 4 weight percent of phosphorus components (calculated as P) on an alumina support, with the catalyst having a surface area in the range of 150 to 175 $m^2$/gm and a mean pore diameter between about 75 and 85 angstroms and a pore size distribution such that at least 75 percent of the pores are in the range of 60 to 100 angstroms.

After hydrotreating, the shale oil product recovered in conduit 5 is substantially reduced in sulfur and nitrogen content, with the former being typically reduced from a value in the range of 0.2 to 1.0 weight percent to values in the 30 to 2,000 wppm range while the latter is reduced from a value in the range of 1.4 to 2.0 weight percent to values below 700 wppm, often as low as 200 to 350 wppm. Since the sulfur and nitrogen, respectively, are converted in hydrotreater 3 to hydrogen sulfide and ammonia, both of these gases are removed in liquid/gas separator 7 and carried away in conduit 9. The remaining liquid shale oil product, although substantially free of sulfur and nitrogen and perhaps having acceptable viscosity indices for some lubricating oil fractions, has a substantially increased overall pour point due to the conversion of olefins to paraffins, with the increase generally being from an original value of about 50° to 60° F. to about 65° to 80° F. for typical Colorado shale oil. In addition, the pour points of most and usually all the lube oil fractions will be unacceptably high, as exemplified hereinbefore in Example I.

The hydrotreated shale oil is introduced via conduit 11 into hydrodewaxing reactor 13 and contacted therein with a hydrodewaxing catalyst under hydrodewaxing conditions so as to substantially reduce the pour point of the hydrotreated shale oil. The conditions of operation in the hydrodewaxing reactor are generally selected as follows:

TABLE VI

HYDRODEWAXING OPERATING CONDITIONS

| Condition | Usual | Preferred |
|---|---|---|
| Temperature, °F. | 650–800 | 700–775 |
| Space Velocity, v/v/hr | 0.1–5.0 | 0.3–2.0 |
| Pressure, p.s.i.g. | 500–2,500 | 1,000–2,500 |
| $H_2$ Recycle Rate, SCF/bbl | 4,000–20,000 | 10,000–18,000 |
| $H_2$ Mole Percent in Recycle Gases | >40 | >70 |

When treating full-range hydrotreated shale oil derived from the western United States, and particularly from the Colorado River formation, it is preferred that conditions for hydrodewaxing be selected and correlated with each other such that the overall pour point is reduced to a value below −40° F., for example, about −65° F.

The hydrodewaxing catalyst may be any having hydrodewaxing catalytic activity, with many such catalysts being presently known. Calalysts comprising a noble metal such as platinum on a large port mordenite-containing support are well known as hydrodewaxing catalysts, as are many catalysts containing a hydrogenation component on a support containing an intermediate pore molecular sieve such as silicalite, ZSM-5, ZSM-11, and the like. The term "intermediate pore" refers to those substances containing a substantial number of pores in the range of about 5 to about 7 angstroms. The term "molecular sieve" as used herein refers to any material capable of separating atoms or molecules based on their respective dimensions. The preferred molecular sieve is a crystalline material, and even more preferably, a crystalline material of relative uniform pore size. The term "pore size" as used herein refers to the diameter of the largest molecule that can be sorbed by the particular molecular sieve in question. The measurement of such diameters and pore sizes is discussed more fully in Chapter 8 of the book entitled "Zeolite Molecular Sieves" written by D. W. Breck and published by John Wiley & Sons in 1974, the disclosure of which book is hereby incorporated by reference in its entirety.

The intermediate pore crystalline molecular sieve which forms one of the components of the preferred hydrodewaxing catalyst may be zeolitic or nonzeolitic, has a pore size between about 5.0 and about 7.0 angstroms, possesses cracking activity, and is normally comprised of 10-membered rings of oxygen atoms. The preferred intermediate pore molecular sieve selectively sorbs n-hexane over 2,2-dimethylbutane. The term "zeolitic" as used herein refers to molecular sieves whose frameworks are formed of substantially only silica and alumina tetrahedra, such as the framework present in ZSM-5 type zeolites. The term "nonzeolitic" as used herein refers to molecular sieves whose frameworks are not formed of substantially only silica and alumina tetrahedra. Examples of nonzeolitic crystalline molecular sieves which may be used as the intermediate pore molecular sieve include crystalline silicas, silicoaluminophosphates, chromosilicates, aluminophosphates, titanium aluminosilicates, titaniumaluminophosphates, ferrosilicates, and borosilicates, provide, of course, that the particular material chosen has a pore size between about 5.0 and about 7.0 angstroms. A more detailed description of silicoaluminophosphates, titaniumaluminophosphates, and the like, which are suitable as intermediate pore molecular sieves for use in the invention, are disclosed more fully in U.S. Patent Application Ser. No. 768,487 filed on Aug. 22, 1985 in the name of John W. Ward, which application is herein incorporated by reference in its entirety.

The most suitable zeolites for use as the intermediate pore molecular sieve in the preferred hydrodewaxing catalyst are the crystalline aluminosilicate zeolites of the ZSM-5 type, such as ZSM-5, ZSM-11, ZSM-12, ZSM-23, ZSM-35, ZSM-38, and the like, with ZSM-5 being preferred. ZSM-5 is a known zeolite and is more fully described in U.S. Pat. No. 3,702,886 herein incorporated by reference in its entirety; ZSM-11 is a known zeolite and is more fully described in U.S. Pat. No. 3,709,979, herein incorporated by reference in its entirety; ZSM-12 is a known zeolite and is more fully described in U.S. Pat. No. 3,832,449, herein incorporated by reference in its entirety; ZSM-23 is a known zeolite and is more fully described in U.S. Pat. No. 4,076,842, herein incorporated by reference in its entirety; ZSM-35 is a known zeolite and is more fully described in U.S. Pat. No 4,016,245, herein incorporated by reference in its entirety; and ZSM-38 is a known zeolite and is more fully described in U.S. Pat. No. 4,046,859, herein incorporated by reference in its entirety. These zeolites are known to readily adsorb benzene and normal paraffins, such as n-hexane, and also certain mono-branched paraffins, such as isopentane, but to have difficulty adsorbing di-branched paraffins, such as 2,2-dimethylbutane, and polyalkylaromatics, such as meta-xylene. These zeolites are also known to have a crystal density not less than 1.6 grams per cubic centimeter, a silica-to-alumina ratio of at least 12, and a constraint index, as defined in U.S. Pat. No. 4,229,282, incorporated by reference herein in its entirety, within the range of 1 to 12. The foregoing zeolites are also known to have an effective pore diameter greater than 5 angstroms and to have pores defined by 10-membered rings of oxygen atoms, as explained in U.S. Pat. No. 4,247,388, herein incorporated by reference in its entirety. Such zeolites are preferably utilized in the acid form, as by replacing at least some of the metals contained in the ion exchange sites of the zeolite with hydrogen ions. This exchange may be accomplished directly with an acid or indirectly by ion exchange with ammonium ions followed by calcination to convert the ammonium ions to hydrogen ions. In either case, it is preferred that the exchange be such that a substantial proportion of the ion exchange sites utilized in the catalyst support be occupied with hydrogen ions.

The most preferred intermediate pore crystalline molecular sieve that may be used as a component of the preferred hydrodewaxing catalyst is a crystalline silica molecular sieve essentially free of aluminum and other Group IIIA metals. (By "essentially free of Group IIIA metals" it is meant that the crystalline silica contains less than 0.75 percent by weight of such metals in total, as calculated as the trioxides thereof, e.g., $Al_2O_3$.) The preferred crystalline silica molecular sieve is a silica polymorph, such as the material described in U.S. Pat. No. 4,073,685. One highly preferred silica polymorph is known as silicalite and may be prepared by methods described in U.S. Pat. No. 4,061,724, the disclosure of which is hereby incorporated by reference in its entirety. Silicalite does not share the zeolitic property of substantial ion exchange common to crystalline aluminosilicates and therefore contains essentially no zeolitic metal cations. Unlike the "ZSM family" of zeolites, silicalite is not an aluminosilicate and contains only trace proportions of alumina derived from reagent impurities. Some extremely pure silicalites (and other microporous crystalline silicas) contain less than about 100 ppmw of Group IIIA metals, and yet others less than 50 ppmw, calculated as the trioxides.

The preferred hydrodewaxing catalyst chosen for use in reactor 13 contains a hydrogenation component in addition to one or more of the foregoing described intermediate pore molecular sieves. Typically, the hydrogenation component comprises a Group VIB metal component, and preferaby both a Group VIB metal component and a Group VIII metal component are present in the catalyst, with the usual and preferred proportions thereof being as specified hereinbefore with respect to the hydrotreating catalyst. Also included in such a catalyst, at least in the preferred embodiment, is a porous refractory oxide, such as alumina, which is mixed with the intermediate pore molecular sieve to provide a support for the active hydrogenation metals. The preferred catalyst contains cobalt and/or nickel components as the Group VIII metal component and molybdenum and/or tungsten as the Group VIB metal component on a support comprising alumina and either ZSM-5 and/or silicalite as the intermediate pore molecular sieve. The most preferred catalyst, usually having a surface area above about 200 $m^2$/gm, is a sulfided catalyst containing nickel components and tungsten components on a support comprising silicalite or ZSM-5 and alumina, with silicalite being the most preferred of all.

One surprising discovery in the present invention is that, at least for hydrotreated Colorado shale oils, the most higly preferred hydrodewaxing catalyst disclosed in U.S. Pat. No. 4,428,862, containing 30 percent by weight silicalite in the support, provides inferior results in the present invention. Specifically, it has been found that the silicalite content of the support must be above about 70 percent by weight, for example, 80 percent by weight, to ensure that all the resultant lube oil fractions will meet the pour point requirement of +10° F. or less. Thus, in the most highly preferred embodiment of the present invention, when a silicalite-containing catalyst, and especially a nickel-tungsten-alumina-silicalite catalyst, is employed as the hydrodewaxing catalyst, silicalite is provided in the support in a proportion of at least 70 percent, and even more preferably, at about 80 percent by weight. (Although no data have yet been obtained for other intermediate pore molecular sieves such as ZSM-5 and ZSM-11, it is believed that such sieves will also provide better performance when present at relatively high levels of 70 percent by weight or more in the support. Therefore, it is preferred in these embodiments that the molecular sieve be provided in the relatively high levels of 70 percent by weight or more.)

After hydrodewaxing, the treated shale oil is passed by line 15 to hydrogenation reactor 17 and therein contacted with a catalyst comprising a hydrogenation metal component, and preferably a noble metal-containing hydrogenation component, under conditions of elevated temperature and pressure and the presence of hydrogen. The preferred hydrogenation catalyst contains an amorphous support, and even more preferably consists essentially of an amorphous support, such as alumina, silica, silica-alumina, etc. The most preferred catalysts are those disclosed in U.S. Pat. No. 3,637,484 which contain platinum and/or palladium dispersed, as by cation exchange, on a support comprising silica-alumina dispersed in an alumina matrix. The most highly preferred of these catalysts are those containing a platinum component as the hydrogenation metal component. The conditions under which the shale oil is passed through the hydrogenation catalyst bed are correlated so as to yield a shale oil product containing at least one lubricating oil fraction, boiling essentially completely above about 690° F. and having at least about a 40° F. differential between the initial and end boiling points, which fraction has a pour point no greater than +10° F. and a viscosity index of at least 95. Typical conditions are selected from the following Table VII:

TABLE VII

| | Usual | Preferred |
|---|---|---|
| Temperature, °F. | 600–800 | 725–775 |
| Pressure, p.s.i.g. | 500–2,500 | 1,500–2,500 |
| Space Velocity, v/v/hr | 0.1–5.0 | 0.2–2.0 |
| $H_2$ Recycle Rate, scf/bbl | 4,000–20,000 | 6,000–16,000 |
| $H_2$ Mole Percent in Recycle Gas | >85 | >90 |

Another surprising discovery uncovered in the present invention is that, whereas the disclosure in U.S. Pat. No. 3,637,484 teaches operating temperatures of 300° to 700° F., it has been found in the present invention that, to maximize the number of lube oil fractions meeting acceptable pour point and viscosity index requirements, a temperature above 700° F., and usually a temperature in the range of 725° to 800° F. is required, with temperatures above 800° F. usually being avoided because of metallurgical constraints associated with the construction materials of reactor 17. Highly preferred temperatures lie in the range of about 725° to 750° F., and the most highly preferred operating temperature is 750° F.

Subsequent to hydrogenation, the shale oil is carried via line 19 to fractionator 21, wherein one or more quality lubricating oil or transformer oil fractions are produced and individually recovered via lines 23, 25, and 27.

One tremendous advantage of the present invention is that, where the process of U.S. Pat. No. 4,428,862 yields a pipelineable shale oil, the added capital expense for a hydrogenation stage as required in the present invention is more than made up for by the higher value of the shale oil lube products yielded. For example, adding the extra hydrogenation stage is estimated to increase the capital expense of the upgrading process taught in U. S.

Pat. No. 4,428,862 by about 20 to 25 percent but the value of the product is roughly doubled.

Another advantage in the invention is that, although the hydrotreating stage is primarily relied upon for reducing the nitrogen and sulfur contents of the shale oil, the hydrodewaxing and hydrogenation stages also effect some reduction in nitrogen and sulfur because of the hydrogenation metals on the catalysts, the elevated temperatures of operation, and the presence of hydrogen. In addition, it has been found that the lubricating oils produced by the method of the invention are highly resistant to sediment formation when exposed to U.V. light. This result is especially of significance, since it is known that lubricating oils produced from shale oils, and in particular from shale oil derived from Colorado oil shale, are characterized by a tendency to develop sediment when exposed to light, with the U.V. component thereof being the known inducer of the sedimentation problem. Thus, it is a distinct advantage in the invention to be able to produce a premium lubricating oil without the additional expense of additives or further refining steps in order to avoid difficulties with sedimentation.

Yet another discovery in the present invention is that hydrogenation with the preferred catalyst in the invention, i.e., the catalyst described in U.S. Pat. No. 3,637,484, effects increases in viscosity index by hydrocracking reactions as well as hydrogenation. Specifically, the usual operating temperatures for hydrogenation herein with this catalyst is above 700° F., for example, above 735° F. At such temperatures, the weakly acidic support of the catalyst becomes active for cracking. Moreover, the cracking is particularly apparent with respect to the polynaphthenic compounds, which contribute to or themselves cause a low viscosity index. That is, it is now known that, during the hydrogenation step using the catalyst described in U.S. Pat. No. 3,637,484, one reason for the increase in viscosity index of shale oils to premium levels is that a significant amount of the polynaphthenic compounds are cracked, due to the activity of the catalyst support, and in the presence of the hydrogenation component and hydrogen, a reaction with hydrogen takes place, i.e., hydrocracking. This phenomenon is shown more fully in the following example:

EXAMPLE III

A full range Colorado shale oil was dearsenited, hydrotreated, and hydrodewaxed in the manner described hereinbefore in Example I. It was then hydrogenated at 750° F. in the manner described in Example II, with the catalyst therein described. The hydrogenation run was then repeated at 725° F. Samples of the 610° F.+ fraction from each run were then fractionated into smaller fractions, and each was then analyzed for pour point, viscosity, viscosity index, and the concentrations of paraffins, polynaphthenes, and mono-naphthenes (such concentrations being determined by mass spectrometry). The results for the hydrogenation run at 725° F. are shown in Table VIII and at 750° F. in Table IX.

TABLE VIII

HYDROGENATION RESULTS OF HYDROTREATED-HYDRODEWAXED SHALE OIL AT 725° F.

| Fraction | Feed | Accumulated Fraction Vol. % | Pour Point °F. | Viscosity cSt 40° C. | Viscosity cSt 100° C | Viscosity VI | Concentration, Wt. % Paraffins | Mono-Naphthenes | Poly-Naphthenes | Total Saturates |
|---|---|---|---|---|---|---|---|---|---|---|
| 610–650° F. | 8.45 | 8.45 | <−65 | 8.599 | 2.258 | 55.7 | 13.3 | 34.3 | 39.5 | 87.2 |
| 650–690° F. | 7.07 | 15.52 | −65 | 13.17 | 2.921 | 51.7 | 11.3 | 34.3 | 38.5 | 84.1 |
| 690–790° F. | 8.32 | 23.84 | −33 | 21.83 | 3.985 | 58.0 | 10.2 | 35.1 | 38.4 | 83.7 |
| 790–830° F. | 7.25 | 31.09 | −22 | 29.54 | 4.835 | 74.8 | 12.3 | 36.7 | 37.2 | 86.2 |
| 830–875° F. | 4.53 | 35.62 | −6 | 39.59 | 5.884 | 86.6 | 13.3 | 36.8 | 36.2 | 86.3 |
| 875° F.+ | 12.39 | 48.01 | +16 | 73.05 | 9.589 | 109.6 | 16.6 | 39.1 | 32.7 | 88.4 |

TABLE IX

HYDROGENATION RESULTS OF HYDROTREATED-HYDRODEWAXED SHALE OIL AT 750° F.

| Fraction | Feed | Accumulated Fraction Vol. % | Pour Point °F. | Viscosity cSt 40° C. | Viscosity cSt 100° C | Viscosity VI | Concentration, Wt. % Paraffins | Mono-Naphthenes | Poly-Naphthenes | Total Saturates |
|---|---|---|---|---|---|---|---|---|---|---|
| 610–650° F. | 6.58 | 6.58 | −54 | 6.828 | 2.012 | 76.8 | 21.4 | 38.8 | 29.2 | 89.3 |
| 650–690° F. | 7.28 | 13.86 | −27 | 9.872 | 2.557 | 80.8 | 20.9 | 39.4 | 27.4 | 87.7 |
| 690–790° F. | 10.30 | 24.16 | −11 | 15.54 | 3.455 | 95.2 | 23.5 | 40.3 | 25.5 | 89.2 |
| 790–830° F. | 3.24 | 27.40 | 0 | 22.76 | 4.497 | 109.7 | 26.5 | 40.0 | 22.8 | 89.3 |
| 830–875° F. | 3.52 | 30.92 | +10 | 29.60 | 5.436 | 120.4 | 30.7 | 38.5 | 20.8 | 89.9 |
| 875° F.+ | 4.95 | 35.87 | +10 | 54.31 | 8.460 | 129.5 | 32.1 | 37.6 | 18.8 | 88.5 |

The data in Tables VIII and IX clearly indicate that, to maximize the number of fractions having a viscosity index at or above 95, it is essential that the polynaphthenic compounds be substantially hydrocracked. It is also noteworthy that both tables indicate that the hydrogenation was to roughly similar saturation levels. This latter fact is important, since the purpose of the hydrogenation catalyst used in this experiment, i.e., the catalyst of U.S. Pat. No. 3,637,484, is taught in the prior art for aromatics saturation with the maximum operating temperature being 700° F. However, the data in Tables VIII and IX plainly indicate that hydrogenating hydrotreated-hydrodewaxed shale oils to aromatics saturation is not enough (at least if one wishes to maximize the number of fractions boiling above 650° F. which have a viscosity index above 95 and a pour point at or below 10° F.). It is also important that a substantial percentage of the polyaromatics undergo carbon-carbon hydrogenolysis, i.e., hydrocracking, as reflected by the fact that relatively inferior results were obtained in Table VIII when the conditions effected hydrocracking to the extent of leaving about 32 to 39 percent polynaphthenic compounds as opposed to about 18 to 29 percent in Table IX. Accordingly, it is one embodiment of the invention to produce lubricating base oil stocks by upgrading hydrocarbon stocks containing constituents boiling above 610° F., preferably above 650° F., with the catalyst of U.S. Pat. No. 3,637,484, in the presence of hydrogen under conditions in which not only is hydrogenation accomplished but also significant hydrocracking of polynaphthenic compounds.

It should also be noted that, although the data in Tables VIII and IX were generated with shale oil feeds, it is clear that other hydrocarbon feedstocks can be upgraded to lubricating base oil stocks as well. The results obtained, of course, will vary from feedstock to feedstock, but the data in Tables VIII and IX indicate that excellent increases in viscosity index can be obtained in the invention for those feedstocks in which polynaphthenic compounds contribute to or are themselves wholly responsible for a relatively low viscosity index. In general, in treating such feeds, the polynaphthenic compounds should be hydrocracked in a substantial proportion, e.g., at least 25%, more preferably at least 40%, by weight, while the bulk of the feedstock is undergoing simultaneous hydrogenation reactions.

Typically and preferably, the pour point of the feed (or at least the majority of those fractions identified in Table IX) is initially at or below +10° F., and the subsequent hydrogenation step, while perhaps increasing the pour point somewhat, yields a product (or the majority of the fractions identified in Table IX) having an increased viscosity index and a pour point still at or below +10° F. Moreover, for the higher boiling fractions, i.e., those boiling at or above 830° F., pour point changes during hydrogenation are relatively small and indeed can remain constant. (Compare the data in Tables III and IV hereinbefore.)

For best results when treating shale oil or other feeds with the catalyst of U.S. Pat. No. 3,637,484, the concentration of organic sulfur allowed to come into contact with the catalyst should be low, usually below about 100 ppmW, preferably below about 20, and more preferably below about 5, ppmw. Higher concentrations can result in catalyst deactivation, and for this reason, most preferred operation is with essentially no organic sulfur components in the feed. In contrast, the catalyst can tolerate higher concentration of hydrogen sulfide, with up to 3,000 ppmv not usually causing any deactivation problems. Typically, however, operation will be with feeds containing less than 2,000 ppmv, preferably less than 1,500 ppmv, of hydrogen sulfide.

Although the invention has been described in conjunction with preferred embodiments, examples, and a drawing, many modifications, variations, and alternatives of the invention will be apparent to those skilled in the art. For example, although the drawing shows the various reactor vessels in downflow configuration, one can also use upflow operation, and indeed, upflow operation may prove more advantageous. Similarly, the drawing shows serial operation with the full-range hydrotreated shale oil being treated in each stage. However, one may also, for example, between the hydrotreating and hydrodewaxing stages, fractionate the shale oil into one or more desired fractions boiling above 610° F., and then individually hydrodewax and hydrogenate each of the recovered fractions requiring further processing to meet appropriate pour point or VI requirements. This alternative embodiment has, of course, the disadvantages of a higher capital cost and greater complexity of operation, but these disadvantages are offset by the advantages of higher yields and less severe operating conditions required for hydrodewaxing and hydrogenation. In yet another embodiment, which is indeed the most highly preferred at the present time, the full-range shale oil is fractionated prior to hydrotreating, for example, into an X-610° F. fraction, a 610°-800° F. fraction, and an 800° F.+ fraction. The heavier fractions may then be separately and serially hydrotreated, hydrocracked, and hydrogenated in accordance with the invention. More preferably, however, all fractions boiling above 610° F. are recombined and then serially hydrotreated, hydrocracked and hydrogenated in accordance with the invention. Accordingly, it is intended to embrace within the invention these and all modifications, variations, and alternatives as fall within the spirit and scope of the appended claims.

We claim:

1. A hydrocarbon upgrading process comprising contacting a hydrocarbon feedstock containing components boiling above 650° F., including polynaphthenic compounds in a concentration greater than 18.8 percent by weight of the components boiling above 650° F., with a catalyst in the presence of hydrogen under conditions of elevated temperature above 700° F. and elevated pressure so as to hydrocrack at least some of said polynaphthenic compounds and increase the viscosity index of the components boiling above 650° F., said catalyst comprising:

(1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

2. A process as defined in claim 1 wherein said elevated temperature is above 735° F. and the viscosity index of the components boiling above 650° F. of the feedstock is below 95 but after said contacting is at least 95.

3. A process as defined in claim 1 wherein said feedstock contains mono-naphthenic compounds boiling above 650° F. and said contacting is such that a greater percentage of the polynaphthenic compounds boiling above 650° F. is converted by hydrocracking than said mono-naphthenic compounds.

4. A process as defined in claim 1 wherein said feedstock contains paraffins boiling above 650° F. and said contacting is such that a greater percentage of the polynaphthenic compounds boiling above 650° F. is converted by hydrocracking than said paraffins.

5. A process for upgrading a hydrocarbon feedstock boiling entirely above 650° F. and having a pour point no greater than +10° F., said hydrocarbon feedstock containing a substantial proportion of polynaphthenic compounds and having a relatively low viscosity index, said process comprising contacting said feedstock with a catalyst in the presence of hydrogen under conditions, including an elevated pressure and an elevated temperature above 700° F., which yield a lubricating base oil product of increased viscosity index, said catalyst comprising:

(1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

6. The process defined in claim 5 wherein said elevated temperature is above 735° F. and said viscosity index of said feedstock is below 95 while that of said lubricating base oil product is at or above 95.

7. A process as defined in claim 5 wherein said feedstock also contains mononaphthenic compounds but a greater percentage of said polynaphthenic compounds are hydrocracked during said contacting than said mononaphthenic compounds.

8. A process comprising contacting a liquid feedstock containing a substantial proportion of polynaphthenic compounds and mononaphthenic compounds with a catalyst in the presence of hydrogen and under conditions of elevated temperature above 700° F. and elevated pressure which convert said feedstock into a liquid product containing a lower percentage of polynaphthenic compounds and a greater percentage of mononaphthenic compounds than said feedstock, said catalyst comprising:

(1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

9. A process as defined in claim 8 wherein at least 25 percent by weight of said polynaphthenic compounds are converted to other hydrocarbons.

10. A process as defined in claim 8 wherein at least about 40 percent of said polynaphthenic compounds are converted to other hydrocarbons.

11. A process comprising contacting a liquid feedstock containing a substantial proportion of polynaphthenic compounds and paraffins with a catalyst in the presence of hydrogen and under conditions of elevated temperature above 700° F. and elevated pressure which convert said feedstock into a liquid product containing a lower percentage of polynaphthenic compounds and a greater percentage of paraffins than said feedstock, said catalyst comprising:

(1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

12. A process as defined in claim 11 wherein at least 30 percent by weight of said polynaphthenic compounds are converted to other hydrocarbons, and the elevated temperature is above 740° F.

13. A process as defined in claim 11 wherein at least about 35 percent of said polynaphthenic compounds are converted to other hydrocarbons, said other hydrocarbons comprising substituted mono-naphthenic compounds.

14. A process comprising contacting a hydrocarbon feedstock containing constituents boiling above 650° F., with a substantial proportion of said constituents being polynaphthenic compounds, with a catalyst under conditions of elevated pressure and a temperature above 700° F. effecting hydrogenation and hydrocracking reactions so as to yield a product containing a fraction boiling above 650° F. of improved viscosity index in comparison to the 650° F.+ fraction of said feedstock, said catalyst comprising:

(1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

15. A process comprising upgrading a hydrocarbon feedstock containing a substantial proportion of components boiling above 650° F., more than 18.8 percent by weight of which components are polynaphthenic compounds, so as to contain a 650° F.+ fraction thereof of higher viscosity index by contacting said feedstock with a catalyst under conditions of elevated temperature above 700° F. and elevated pressure so as to effect simultaneous hydrogenation and hydrocracking reactions, said catalyst comprising:

(1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

16. A process as defined in claim 15 wherein said contacting results in the conversion of a substantial proportion of said polynaphthenic compounds.

17. A process as defined in claim 16 wherein said feedstock further contains paraffins and mononaphthenic compounds and said paraffins and mononaphthenic compounds undergo less of a percentage conversion to other compounds than said polynaphthenic compounds during said contacting.

18. In the production of lubricating oils, the improvement wherein a premium lubricating oil is produced from components boiling above 650° F. in a feedstock containing a substantial proportion of polynaphthenic compounds and a substantial proportion of components boiling above 650° F. by hydroprocessing so as to effect hydrocracking reactions at a temperature above 700° F. with a catalyst comprising (1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

19. A process as defined in claim 18 wherein said polynaphthenic compounds are, during said contacting, converted to other compounds, including mono-naphthenic compounds, in a substantial percentage.

20. A process as defined in claim 1 wherein said elevated temperature is above 735° F.

21. A process as defined in claim 20 wherein at least 40 percent by weight of said polynaphthenic compounds are hydrocracked to other hydrocarbons.

22. A process as defined in claim 1 wherein at least 25 percent by weight of said polynaphthenic compounds are hydrocracked to other hydrocarbons.

23. A process as defined in claim 3 wherein said elevated temperature is above 740° F.

24. A process as defined in claim 4 wherein said elevated temperature is above 740° F.

25. A process as defined in claim 5 wherein said viscosity index of said feedstock is below 95 while that of said lubricating base oil product is at or above 95.

26. A process as defined in claim 7 wherein said viscosity index of said feedstock is below 95 while that of said lubricating base oil product is at or above 95.

27. A process as defined in claim 26 wherein said elevated temperature is above 740° F.

28. A process as defined in claim 5 wherein said base oil product has a pour point no greater than +10° F.

29. A process as defined in claim 6 wherein said base oil product has a pour point no greater than +10° F.

30. A process as defined in claim 5 wherein said elevated temperature is above 735° F.

31. A process as defined in claim 30 wherein said base oil product has a pour point no greater than +10° F.

32. A process as defined in claim 8 wherein said elevated temperature is about 725° to 800° F.

33. A process as defined in claim 9 wherein said elevated temperature is above 735° F.

34. A process as defined in claim 10 wherein said elevated temperature is above 740° F.

35. A process as defined in claim 11 wherein said elevated temperature is above 735° F.

36. A process as defined in claim 13 wherein said elevated temperature is above 740° F.

37. A process as defined in claim 14 wherein at least 25 percent by weight of said polynaphthenic compounds are hydrocracked to other hydrocarbons.

38. A process as defined in claim 37 wherein said elevated temperature is above 735° F.

39. A process as defined in claim 14 wherein said elevated temperature is above 740° F.

40. A process as defined in claim 39 wherein at least 40 percent by weight of said polynaphthenic compounds are hydrocracked to other hydrocarbons.

41. A process as defined in claim 17 wherein said elevated temperature is above 735° F.

42. In the production of lubricating oils by hydroprocessing with a catalyst, the improvement comprising contacting at a temperature above 700° F. a feed hydrocarbon containing components boiling above 650° F., more than 18.8 percent by weight of which components are polynaphthenates, with a catalyst comprising (1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

43. A process as defined in claim 42 wherein said feed hydrocarbon contains polynaphthenates boiling above 650° F. and said contacting is in the present of hydrogen and under conditions of elevated pressure so as to yield a product hydrocarbon containing a lubricating base oil product boiling above 650° F.

44. A process as defined in claim 43 wherein a substantial proportion of said polynaphthenates are hydrocracked during said contacting.

45. A process as defined in claim 42 wherein hydrocracking and hydrogenation reactions occur during said contacting, and polynaphthenates boiling above 650° F. are hydrocracked.

46. A process as defined in claim 45 wherein at least 25 percent by weight of said polynaphthenates are hydrocracked.

47. A process as defined in claim 42 wherein the viscosity index of the 650° F.+ components is increased by substantial hydrogenation and hydrocracking reactions.

48. A process as defined in claim 47 wherein at least 25 percent by weight of said polynaphthenates are hydrocracked during said contacting.

49. A process as defined in claim 42 wherein said temperature is above 735° F.

50. A process as defined in claim 44 wherein said temperature is above 735° F.

51. A process as defined in claim 46 wherein said temperature is above 735° F.

52. A process as defined in claim 47 wherein said temperature is above 740° F.

53. A process as defined in claim 48 wherein said temperature is above 740° F.

54. A process as defined in claim 48 wherein the viscosity index of the components boiling above 650° F. is below 95 but after said contacting is at least 95.

55. A process as defined in claim 54 wherein said feedstock contains mononaphthenic compounds boiling above 650° F. and said contacting is such that a greater percentage of the polynaphthenic compounds boiling above 650° F. is converted by hydrocracking than said mononaphthenic compounds.

56. A process as defined in claim 55 wherein said feedstock contains paraffins boiling above 650° F. and said contacting is such that a greater percentage of the polynaphthenic compounds boiling above 650° F. is converted by hydrocracking than said paraffins.

57. A process as defined in claim 56 wherein said 650° F.+ components of the feed have a pour point no greater than +10° F., which pour point is not increased above +10° F. during said contacting.

58. A process as defined in claim 55 wherein said temperature is above 735° F.

59. A process as defined in claim 54 wherein said temperature is above 740° F.

60. A process as defined in claim 57 wherein said temperature is above 740° F.

61. A process as defined in claim 60 wherein at least 40 percent by weight of said polynaphthenic compounds are hydrocracked to other hydrocarbons.

62. A process comprising contacting a liquid feedstock comprising mononaphthenic compounds and more than 18.8 percent by weight of polynaphthenic compounds with a catalyst in the presence of hydrogen and under conditions of elevated temperature above 700° F. and elevated pressure which convert said feedstock into a liquid product containing a lower percentage of polynaphthenic compounds and a greater percentage of mononaphthenic compounds than said feedstock, said catalyst comprising:

(1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

63. A process as defined in claim 62 wherein at least 25 percent by weight of said polynaphthenic compounds are converted to other hydrocarbons.

64. A process as defined in claim 62 wherein at least about 40 percent of said polynaphthenic compounds are converted to other hydrocarbons.

65. A process as defined in claim 62 wherein said elevated temperature is about 725° to 800° F.

66. A process as defined in claim 63 wherein said elevated temperature is above 735° F.

67. A process as defined in claim 64 wherein said elevated temperature is above 740° F.

68. A process comprising contacting a liquid feedstock comprising paraffins and more than 18.8 percent by weight of polynaphthenic compounds with a catalyst in the presence of hydrogen and under conditions of elevated temperature above 700° F. and elevated pressure which convert said feedstock into a liquid product containing a lower percentage of polynaphthenic compounds and a greater percentage of paraffins than said feedstock, said catalyst comprising:

(1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores in diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

69. A process as defined in claim 68 wherein at least 30 percent by weight of said polynaphthenic compounds are converted to other hydrocarbons, and the elevated temperature is above 740° F.

70. A process as defined in claim 68 wherein at least about 35 percent of said polynaphthenic compounds are converted to other hydrocarbons, said other hydrocarbons comprising substituted mono-naphthenic compounds.

71. A process as defined in claim 68 wherein said elevated temperature is above 735° F.

72. A process as defined in claim 70 wherein said elevated temperature is above 740° F.

73. A process as defined in claim 1 wherein more than about 27.4 weight percent of the 650° F.+ fraction of said feedstock comprises polynaphthenic compounds.

74. A process as defined in claim 3 wherein more than about 27.4 weight percent of the 650° F.+ fraction of said feedstock comprises polynaphthenic compounds.

75. A process as defined in claim 6 wherein more than about 27.4 weight percent of the said feedstock comprises polynaphthenic compounds.

76. A process as defined in claim 14 wherein more than about 27.4 weight percent of the 650° F.+ fraction of said feedstock comprises polynaphthenic compounds.

77. A process as defined in claim 15 wherein more than about 27.4 weight percent of the 650° F.+ fraction of said feedstock comprises polynaphthenic compounds.

78. A process as defined in claim 17 wherein more than about 27.4 weight percent of the 650° F.+ fraction of said feedstock comprises polynaphthenic compounds.

79. A process as defined in claim 18 wherein more than about 27.4 weight percent of the 650° F.+ fraction of said feedstock comprises polynaphthenic compounds.

80. A process as defined in claim 21 wherein more than about 27.4 weight percent of the 650° F.+ fraction of said feedstock comprises polynaphthenic compounds.

81. A process as defined in claim 27 wherein more than about 27.4 weight percent of the 650° F.+ fraction of said feedstock comprises polynaphthenic compounds.

82. A process as defined in claim 40 wherein more than about 27.4 weight percent of said feedstock comprises polynaphthenic compounds.

83. A process as defined in claim 47 wherein more than about 27.4 weight percent of the 650° F.+ fraction of said feedstock comprises polynaphthenic compounds.

84. A process as defined in claim 61 wherein more than about 27.4 weight percent of the 650° F.+ fraction of said feedstock comprises polynaphthenic compounds.

85. A process as defined in claim 73 wherein less than about 40.3 weight percent of the 650° F.+ fraction of said feedstock comprises mononaphthenic compounds.

86. A process as defined in claim 81 wherein less than about 40.3 weight percent of said feedstock comprises mononaphthenic compounds.

87. A process as defined in claim 82 wherein less than about 40.3 weight percent of the 650° F.+ fraction of said feedstock comprises mononaphthenic compounds.

88. A process as defined in claim 77 wherein less than about 40.3 weight percent of the 650° F.+ fraction of said feedstock comprises mononaphthenic compounds.

89. A process as defined in claim 80 wherein less than about 40.3 weight percent of the 650° F.+ fraction of said feedstock comprises mononaphthenic compounds.

90. A process as defined in claim 75 wherein less than about 40.3 weight percent of said feedstock comprises mononaphthenic compounds.

91. A process as defined in claim 84 wherein less than about 40.3 weight percent of the 650° F.+ fraction of said feedstock comprises mononaphthenic compounds.

92. A process as defined in claim 91 wherein less than about 32.1 weight percent of the 650° F.+ fraction of said feedstock comprises paraffins.

93. A process as defined in claim 74 wherein less than about 32.1 weight percent of the 650° F.+ fraction of said feedstock comprises paraffins.

94. A process as defined in claim 85 wherein less than about 32.1 weight percent of the 650° F.+ fraction of said feedstock comprises paraffins.

95. A process as defined in claim 1 wherein said conditions are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

96. A process as defined in claim 5 wherein said conditions are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

97. A process as defined in claim 14 wherein said conditions are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

98. A process as defined in claim 17 wherein said conditions are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

99. A process as defined in claim 21 wherein said conditions are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

100. A process as defined in claim 27 wherein said conditions are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

101. A process as defined in claim 42 wherein said contacting is under conditions adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

102. A process as defined in claim 49 wherein said contacting is under conditions adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

103. A process as defined in claim 79 wherein said hydroprocessing is conducted under conditions adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

104. A process as defined in claim 81 wherein said conditions are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

105. A process as defined in claim 92 wherein said contacting is under conditions adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

* * * * *

UNITED STATES PATENT AND TRADEMARK OFFICE

CERTIFICATE OF CORRECTION

PATENT NO. : 4,744,884

DATED : May 17, 1988

INVENTOR(S) : Eric L. Moorehead and Sidney Y. Shen

It is certified that error appears in the above-identified patent and that said Letters Patent is hereby corrected as shown below:

In column 18, lines 49, 50, and 51, delete "said feed hydrc-carbon contains polynaphthenates boiling above 650° F. and".

In column 18, line 51, change "present" to --presence--.

In column 19, line 20, change "polynaphthenic compounds" to --polynaphthenates--.

In column 19, line 26, change "polynaphthenic compounds" to --polynaphthenates--.

In column 19, line 39, change "polynaphthenic compounds" to --polynaphthenates--.

In column 20, line 55, delete "the".

In column 21, line 10, delete "of the 650° F.+ fraction".

Signed and Sealed this

First Day of November, 1988

*Attest:*

DONALD J. QUIGG

*Attesting Officer*

*Commissioner of Patents and Trademarks*